United States Patent [19]

Mathis et al.

[11] Patent Number: 4,576,483

[45] Date of Patent: Mar. 18, 1986

[54] APPARATUS FOR MIXING AND METERING FLOWABLE SOLID MATERIALS

[75] Inventors: Paul Mathis; Bernhard Mathis; Franz Mathis, all of Merdingen; Wilhelm Zimmerer, Münstertal, all of Fed. Rep. of Germany

[73] Assignee: Mathis System-Technik GmbH, Neuenburg, Fed. Rep. of Germany

[21] Appl. No.: 632,431

[22] Filed: Jul. 19, 1984

[30] Foreign Application Priority Data

Jul. 21, 1983 [DE] Fed. Rep. of Germany ..... 3326247

[51] Int. Cl.[4] ..... B28C 5/08

[52] U.S. Cl. ..... 366/65; 366/191; 366/194; 366/295

[58] Field of Search ..... 366/65, 66, 139, 191, 366/194, 293, 295, 292, 296, 279

[56] References Cited

U.S. PATENT DOCUMENTS

| | | | |
|---|---|---|---|
| 2,249,263 | 7/1941 | Wheelwright | 366/295 |
| 2,953,359 | 9/1960 | Mau | 366/295 |
| 3,523,761 | 8/1970 | Graham | 366/139 |
| 3,589,686 | 6/1971 | Russell | 366/139 |
| 4,175,873 | 11/1979 | Iwako | 366/295 |
| 4,272,198 | 6/1981 | Velikov | 366/65 |

*Primary Examiner*—Robert W. Jenkins

*Attorney, Agent, or Firm*—Peter K. Kontler

[57] ABSTRACT

The centrally located outlet in the bottom portion of a silo for a flowable solid building material or fertilizer discharges directly into a first chamber of a mixing unit having a vertical shaft which is coaxial with the outlet and rotates one or more first tools in the first chamber to uniformly distribute the inflowing material and to reduce its tendency to become separated into two or more ingredients. The thus pretreated material descends into a second chamber and into the range of one or more rotating second tools which are driven by the shaft and intermix the material with one or more liquids before the finished product enters an evacuating pump which conveys it to one or more locations of use or to further processing units. The utilization of a vertical shaft and of parts which rotate about one or more vertical axes reduces the wear and prolongs the useful life of such moving parts. The housing of the mixing unit is attached directly to the silo and is pivotable to and from a position of register of its first chamber with the outlet.

41 Claims, 11 Drawing Figures

APPARATUS FOR MIXING AND METERING FLOWABLE SOLID MATERIALS

BACKGROUND OF THE INVENTION

The present invention relates to improvements in apparatus for treating flowable solid materials, such as building materials, fertilizers, mixtures of two or more flowable solid ingredients and the like. More particularly, the invention relates to improvements in apparatus for mixing and metering flowable solid materials.

German Offenlegungsschrift No. 23 40 246 discloses an apparatus wherein the outlet in the lower portion of a silo for a supply of stored flowable solid material is disposed at a level above a mixing unit embodying a continuously operated mixing pump whose housing is suspended on and below the outlet of the silo. Such mounting of the mixing pump on the silo is intended to obviate the need for a pneumatic conveyor which operates with compressed air and, in certain conventional apparatus, is used to transport flowable material from the main source to the mixing pump. The directly mounted mixing pump, its motor, the shaft which is driven by the motor and a second pump which evacuates the intermixed materials are mounted on the silo in an inclined position so that the material which is being treated advances downwardly and laterally on its way from the outlet of the normally upright silo or an analogous source of untreated material. Such inclined mounting of the mixing unit necessitates the provision of an intermediate piece or adapter which connects the region of the outlet of the silo with the inlet of the mixing pump and acts not unlike a flow restrictor. In other words, the material cannot issue from the silo at the rate which would be possible in view of the cross-sectional area of the outlet. Moreover, inclined mounting of the mixing unit below the outlet of an upright silo or an analogous source of flowable material is undesirable when the material in the silo contains several ingredients which are likely to become separated as a result of a more or less pronounced classifying action which takes place during flow of intermixed ingredients through the aforementioned adapter and into the inlet of the mixing pump. Such tendency of intermixed ingredients to become separated from one another depends on their specific weight, their particle size and/or other parameters such as the length of the path between the outlet of the silo and the inlet of the mixing pump, the slope of the path which is defined by the adapter, the extent of the flow restricting action of the adapter and others. Still another drawback of the just discussed conventional mixing apparatus is that, owing to inclined mounting of the mixing pump, mixing shaft, evacuating pump and other components of such apparatus, the wear upon the bearings for the rotary parts is not uniform. The same holds true for the blades, paddles, arms or analogous mixing elements which are used in such units.

German Pat. No. 29 03 373 discloses a modified mixing apparatus which is mounted in a substantially horizontal position or slopes slightly upwardly for the purpose of admitting treated material into receptacles having relatively high sidewalls. Such mixing units are quite satisfactory for the admission of treated materials into containers whose rims are disposed at or above the level of the mixing unit. A drawback is that the direction of the material flow must be reversed or otherwise drastically changed on the way from the outlet of the source to the container or containers for the treated material. Thus, the material issues from the source by flowing vertically downwardly, and the material thereupon flows horizontally or upwardly in order to enter a receptacle. Such changes in the direction of flow of treated material are highly undesirable under a number of circumstances, for example, when the material is not readily flowable or when the material is a mixture of several ingredients which tend to become separated from one another. The tendency of various ingredients to become separated from each other is especially pronounced if the ingredients have different particle sizes, densities and/or shapes as well as if the ingredients tend to densify. Such types of materials cannot be metered with a requisite degree of accuracy because the predictability of metering action is adversely influenced by changes in the extent to which the various ingredients are intermixed with one another. Consequently, if the mixing operation involves the admission of binding agents and/or other types of additives, the additives must be admitted in larger quantities than absolutely necessary in order to avoid the formation of batches wherein the percentage of additives is too low. This contributes to the cost of the treated product, especially if the additives are expensive binding agents or the like. For example, when the material which is discharged by way of the outlet in the lower part of a silo is a building material which must be mixed with cement or the like, a minimum percentage of cement must be present in each batch of the treated product in order to ensure that the finished product will exhibit a certain minimum amount of stability after setting.

Another conventional mixing apparatus for building materials or the like is disclosed in German Offenlegungsschrift No. 20 34 837.

OBJECTS AND SUMMARY OF THE INVENTION

An object of the invention is to provide a novel and improved apparatus which is capable of mixing and metering flowable solid materials or mixtures of flowable solid and liquid materials with a higher degree of predictability than heretofore known apparatus.

Another object of the invention is to provide an apparatus which is constructed and assembled in such a way that the various ingredients of the starting material are much less likely to become segregated from one another than in heretofore known apparatus.

A further object of the invention is to provide an apparatus which can effectively counteract the tendency of the ingredients of the starting flowable material to become separated from each other.

An additional object of the invention is to provide an apparatus which ensures that the rate of admission of expensive additives need not exceed or need not appreciably exceed the minimum acceptable rate without adversely influencing the consistency and/or other qualities of the ultimate product.

Still another object of the invention is to provide an apparatus which can turn out products whose homogeneousness at least matches but normally greatly exceeds the homogeneousness of products which are obtained in conventional mixing and metering apparatus for building materials and the like.

A further object of the invention is to provide an apparatus which is constructed and assembled in such a way that the wear upon its parts is less pronounced and more uniform than in heretofore known apparatus.

Another object of the invention is to provide novel and improved means for transmitting motion to the moving parts of the above outlined apparatus.

An additional object of the invention is to provide an apparatus which can stand long periods of uninterrupted use, which can admix to the flowable material or materials any desired practical number of solid and/or liquid additives, and which occupies less room than heretofore known mixing and metering apparatus.

A further object of the invention is to provide a novel and improved method of mixing and metering flowable solid materials at the rate at which such materials issue from an upright silo or another suitable source.

An additional object of the invention is to provide a mixing and metering apparatus which can be installed on existing silos as a superior substitute for heretofore known apparatus.

The invention is embodied in a mixing and metering apparatus for flowable solid materials, such as various types of building materials, fertilizers, mixtures of two or more flowable solid ingredients and the like. The apparatus comprises a source of supply of flowable material (e.g., an upright silo) whose lower portion (e.g., a funnel-shaped portion) has a preferably centrally located outlet, and a mixing unit for the material which issues from the silo by way of the outlet. The mixing unit has an upper mixing chamber which receives flowable material from the outlet, first mixing means including at least one mobile preliminary or first mixing tool in the upper chamber, a second mixing chamber which is disposed below the upper chamber and receives material thereform, a vertical drive shaft at a level below the outlet, and second mixing means including at least one second or main mixing tool which is disposed in the second chamber and receives motion from the shaft. The silo is preferably supported by legs at a certain level above the ground, and the entire mixing unit can be installed between such legs at a level below the outlet. The apparatus further comprises a prime mover for the shaft, and such prime mover preferably includes a motor (e.g., a reversible electric motor) which is disposed laterally of the shaft and transmission means connecting the output element of the motor with the shaft. The transmission means can comprise one or more endless chains, especially if the output element of the motor is parallel to the shaft of the mixing unit. If the output element of the motor extends transversely of the shaft, the transmission means can include a bevel gear transmission, a spur gear transmission or a Cardan joint. An at least substantially closed case or casing can be provided for the transmission, and a portion of such case can extend into the mixing unit.

The apparatus can further comprise one or more sources of liquid and one or more conduit means for admitting liquid from the respective source or sources into the mixing unit, preferably at least substantially coaxially with the shaft and into the second chamber of the mixing unit. Means is provided to evacuate flowable material from the second chamber, and such evacuating means can comprise a pump (e.g., a spindle drag pump) which is preferably coaxial with and is disposed at a level below the shaft of the mixing unit.

The first tool or tools may but need not receive motion from the vertical shaft. Also, the first tool can be disposed at a level below the aforementioned portion of the transmission case in the mixing unit, and such portion of the case can include or constitute a roof-shaped member having a ridge facing the outlet of the silo to divide the descending stream of flowable material into two preferably equal streams which are directed into the upper chamber and into the range of the first tool or tools therein. The width of the roof-shaped member need not exceed the width of the remaining part of the case in the mixing unit. Alternatively, or in addition to the just discussed construction, the shaft of the mixing unit can extend upwardly above the roof-shaped member of the case and can carry one or more first treating tools so that the material which flows by gravity from the silo is first homogenized by the tool or tools above the roof-shaped member, is thereupon divided into two streams by the roof-shaped member, and is thereafter treated by one or more first tools in the upper chamber before it enters the range of the second tool or tools in the second chamber. Each first tool can constitute or include a rotary member.

The connection between the motor and the mixing unit can comprise a first transmission (e.g., a chain transmission) which transmits torque from the output element of the motor to the vertical shaft of the mixing unit, and a second transmission which transmits torque from the output element to the first tool or tools. The ratio of the two transmissions may but need not be the same; for example, the RPM of the first tool or tools can be lower than the RPM of the vertical shaft and the second tool or tools. The second transmission can drive a rotary disc-shaped or plate like carrier for one or more blade-, arm- or paddle-like first tools which can be inclined upwardly and outwardly with reference to the vertical shaft in a direction toward, into or even beyond the outlet. The first tool or tools can be movably secured to the carrier, e.g., by means of hinges so that each first tool can be pivoted to an operative or erected position in which it extends toward, into or beyond the outlet and a second or collapsed position in which it overlies the carrier and is located in the mixing unit. The material-contacting surface or surfaces of each first tool can extend at least substantially or partly radially of the vertical shaft to enhance the stirring, agitating and/or homogenizing and flow-promoting action of such first tool or tools. The arrangement may be such that the first tool or tools are automatically caused to move from collapsed to operative positions in response to rotation of their carrier in a first direction and that they automatically return to the collapsed positions in response to rotation of the carrier in the opposite direction. The silo can comprise a substantially conical wall which surrounds the outlet and tapers downwardly and inwardly, and each first tool can be inclined in the same way when it assumes its operative position and is then preferably closely adjacent to the inner side of such tapering wall of the silo to reduce the likelihood of agglomeration of flowable material in the region of the outlet. For example, the first mixing means can comprise two first tools which are mounted on a common carrier diametrically opposite each other with reference to the axis of the vertical shaft.

Means can be provided to secure the mixing unit directly to the silo, preferably in such a way that the mixing unit is movable between a first position of register and a second position out of register with the outlet of the silo. For example, the supporting means can define for the mixing unit a substantially vertical pivot axis which is laterally adjacent to the outlet. Still further, the apparatus can comprise means for sealing the outlet in response to movement of the mixing unit out of register with the outlet. Such sealing means can comprise a lid which shares the movements of the mixing unit relative to the silo.

Alternatively, the supporting means can define for the mixing unit a substantially horizontal pivot axis about which the mixing unit is pivotable to place its upper chamber into and out of register with the outlet of the silo. The apparatus then preferably comprises a closure which is movable into and from sealing engagement with the outlet and is also movable relative to the mixing unit. Such closure can be arranged to pivot about a substantially vertical axis.

The mixing unit can comprise a turntable which is mounted in a housing of the mixing unit and includes one or more second tools at its upper side and one or more second tools at its underside. The turntable can be mounted at a level below the outlet or outlets for the admission of liquid into the mixing unit.

The bottom wall of the housing of the mixing unit has a substantially centrally located opening which discharges the product into the range of the aforementioned pump. The bottom wall of the housing is disposed below the second chamber and its inner side slopes toward the opening; such inner side can have a concave shape and the adjacent portion or portions of the second tool or tools are preferably configurated in such a way that they conform to the outline of the inner side of the bottom wall.

The housing can be provided with a flange which is disposed immediately below and registers with the outlet of the silo. This flange can have a circumferentially complete edge portion which is either rounded (e.g., chamfered) or sharp so as to facilitate the movement of the flange into and from register with the lower portion of the silo. Such configuration of the flange is desirable and advantageous when the housing of the mixing unit is pivotable about a vertical axis which is laterally adjacent to the outlet of the silo.

Still further, the apparatus can be equipped with detector means for monitoring the level of the liquid in the housing of the mixing unit and for generating signals when the liquid rises to a preselected level, e.g., into the interior of the upper chamber. The signals can be used to arrest the motor for the vertical shaft and/or to warn the attendants that the operation of the mixing unit is unsatisfactory. Also, the signals from such detector means can be used to interrupt the admission of liquid into the housing of the mixing unit.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
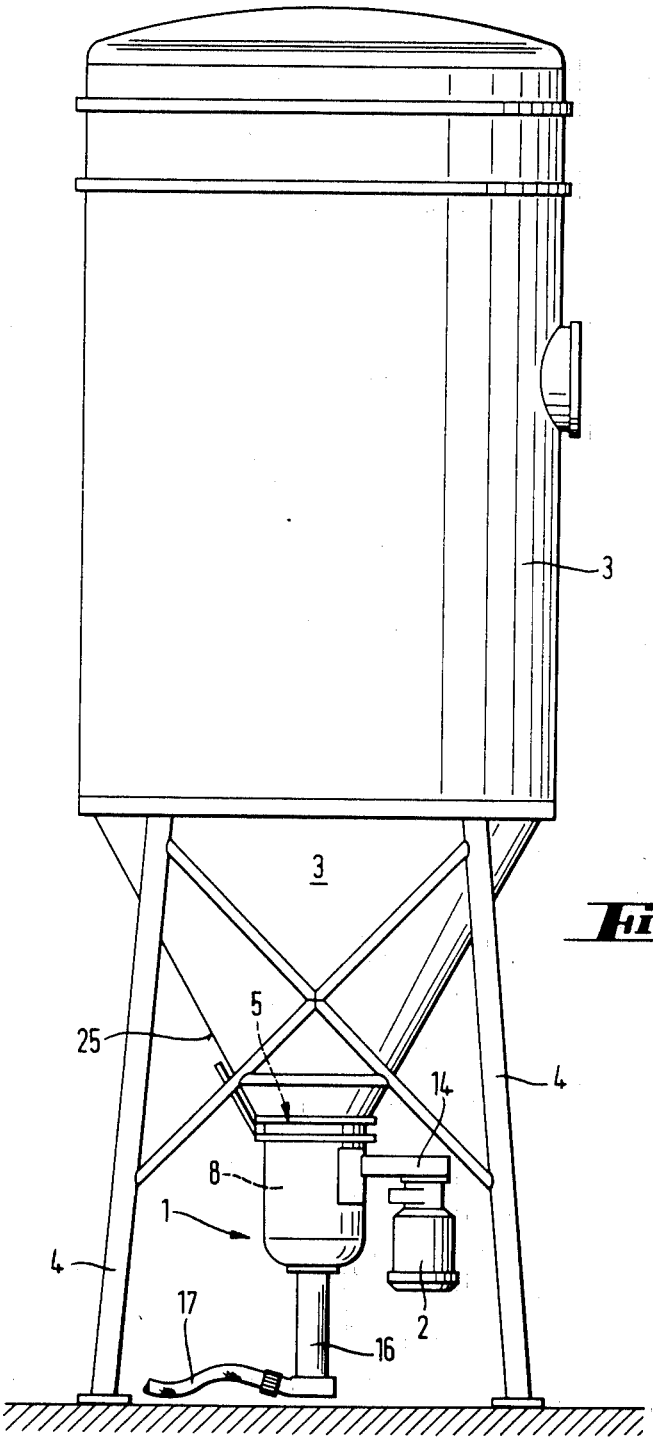
FIG. 1 is a schematic side elevational view of a silo for storage of a supply of flowable solid material and of a mixing unit which forms part of the improved apparatus and is mounted directly at the lower end of the silo.

Referring first to FIG. 1, there is shown a mixing unit 1 which is disposed at a level below a source of supply of flowable solid material. The source is an upright silo 3 which has several ground-contacting legs 4 and whose lower portion 25 resembles a downwardly tapering funnel with a centrally located outlet 5 (see FIG. 2). The silo 3 can store a substantial supply of building material, fertilizer or a mixture of two or more flowable solid ingredients. The purpose of the unit 1 is intimately mix the ingredients of the material which is supplied by gravity via outlet 5 and one or more additional materials and to deliver metered quantities of the resulting mixture to one or more consumers, e.g., to different processing machines at a construction site or the like. The drive means for the moving parts of the mixing unit 1 comprises a prime mover 2 which is an electric motor having a vertical output element 12 extending into a transmission case 14 which accommodates means for transmitting torque from the output element 12 to the vertical shaft 6 of the mixing unit 1. The shaft 6 is coaxial with the funnel-shaped portion 25 which forms part of the silo 3 and defines the outlet 5. The lower end of the portion 25 has a flange **25*a* which is affixed to the adjacent flange 30 (see FIGS. 8 and 9) of the housing H of the mixing unit 1 by a vertical pivot member 29, i.e., the mixing unit 1 is directly affixed to the source of flowable solid material which is supplied via outlet 5**. There is no need for interposition of one or more adapters or the like.

The housing H of the mixing unit 1 defines a first or upper or preliminary mixing chamber 8 which receives flowable material directly from the outlet 5 of the funnel 25 and contains one or more preliminary (first) mixing or agitating tools 9 receiving torque from the vertical shaft 6 and serving to distribute the flowable material on its way into a second, lower or main mixing chamber 18 containing one or more second or primary or main mixing tools 7. The tool or tools 7 also receive torque from the vertical shaft 6.

The motor 2 is laterally adjacent to the mixing unit 1 and its housing is attached to the transmission case 14 which at least substantially confines the transmission between the output element 12 and the vertical shaft 6 and extends into the housing H of the mixing unit 1. The output element 12 of the motor 2 is parallel to the shaft 6 of the mixing unit 1, and the transmission in the case 14 contains at least one endless chain which is trained over sprocket wheels 13 and 26. The chain or chains have been omitted for the sake of clarity.

It is also within the purview of the invention to install the motor 2 or another suitable prime mover in such a way that its output element is horizontal or is otherwise inclined relative to the vertical shaft 6 and to employ one or more transmissions including sets of bevel gears, spur gears or Cardan joints. This depends on the availability of space in the region of the mixing unit 1 and on the availability of transmissions of a particular kind. The selected transmission or transmissions can transmit torque from the output element of the prime mover to the vertical shaft 6 through the medium of an intermediate shaft, a set of intermediate gears or the like.

The mixing chambers 8 and 18 are concentric and are disposed one above the other, and the first and second mixing tools 9 and 7 are driven to rotate about a common vertical axis (of the shaft 6). At least one conduit 107 can be provided to admit a liquid substantially coaxially with the shaft 6 and into the second mixing chamber 18 so that such liquid is mixed with the solid material that enters the chamber 18 from the chamber 8 under the action of the first mixing tool or tools 9. The source of liquid is schematically shown at 207; such source can contain water or another liquid medium which is to be mixed with the solid material in order to form a mass which is ready for use at construction sites or the like. The housing H has a radially disposed opening 15 for admission of air which is drawn into the housing by the rotating second tool or tools 7 to form bubbles in the mixture which descends into the range of an evacuating pump 16, e.g., a so-called spindle drag pump which admits metered quantities of the mixture into one or more flexible conduits 17 leading to one or more consumers. The admixture of air bubbles into the material which is treated in the second chamber 18 not only promotes the ability of the material to flow toward and into the pump 16 but also enhances certain other characteristics of the material such as its thermal insulating properties and/or others. It has been found that, if the mixture which enters the pump 16 contains a requisite percentage of air bubbles, it can be conveyed (via one or more conduits 17) through considerable distances, e.g., through distances of 60 meters or more. This is especially desirable at a construction site where a single mixing unit 1 and its pump 16 can supply mixtures of building materials to several consumers at different levels well above the ground. The material which is conveyed via conduit or conduits 17 may be plaster, mortar or the like.

Figure 2:
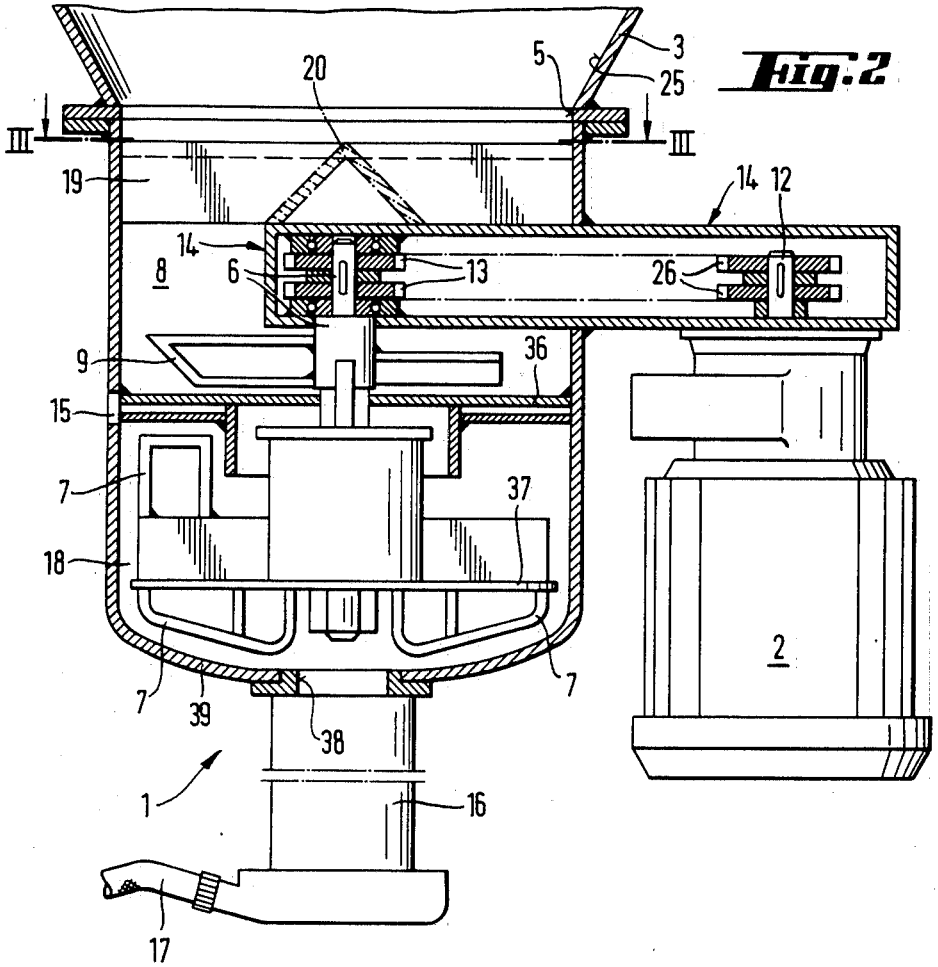
FIG. 2 is an enlarged partly elevational and partly vertical sectional view of the apparatus which is shown in FIG. 1, with the chains which transmit torque from the motor to the vertical shaft of the mixing unit omitted.
Figure 3:
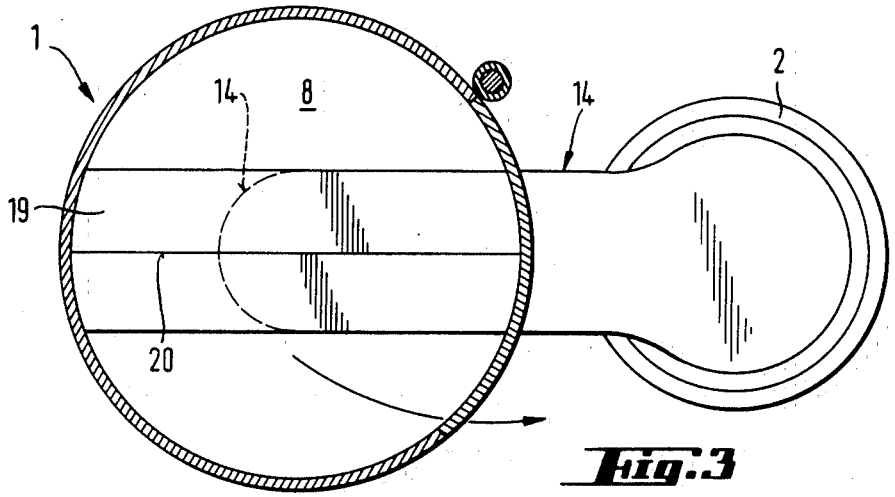
FIG. 3 is a plan view of the structure which is shown in FIG. 2.

As can be seen in FIG. 2, the first mixing tool 9 is disposed at a level below the adjacent portion of the case 14 in the lower part of the first mixing chamber 8 to agitate and circulate as well as to uniformly distribute flowable solid material which leaves the funnel 25 of the silo 3 via outlet 5 and is distributed or dispersed by a ridge 20 on a roof-shaped upwardly extending part 19 of the case 14 in the housing H. The first chamber 8 can contain two or more rotary blade- or paddle-like tools 9 or otherwise configurated preliminary mixing tools. The width of the part 19, as considered at right angles to the plane of FIG. 2, need not exceed the width of the remaining portion of the case 14. This can be seen in FIG. 3. The section of the part 19 is shown in FIG. 2 turned through 90 degrees in order to more clearly show the roof-shaped outline of such part and its ridge 20. In actual practice, and as shown in FIG. 3, the part 19 extends longitudinally of the case 14, i.e., at right angles to the axis of the output element 12 of the motor 2. The part 19 can extend along the full length of the case 14 or only along that portion of the case 14 which is located in the interior of the housing H of the mixing unit 1. The purpose of the part 19 is to divide the descending stream of flowable solid material into two preferably identical partial streams which enter the first chamber 8 and are circulated, agitated and uniformly distributed by the first tool or tools 9. The provision of the part 19, together with the chamber 8 and its tool or tools 9, contributes to uniformity of the rate of admission of flowable solid material into the second or main mixing chamber 18 of the unit 1. Moreover, the first tool or tools 9 counteract any tendency of the ingredients of the flowable material which leaves the funnel-shaped portion 25 of the silo 3 to become separated from one another due to differences in size, weight and/or other parameters. Thus, the second mixing chamber 18 receives a homogeneous mixture of ingredients which constitute the flowable material that descends by way of the outlet 5 and flows into the first chamber 8 on its way into the main mixing chamber 18.

Figure 4:
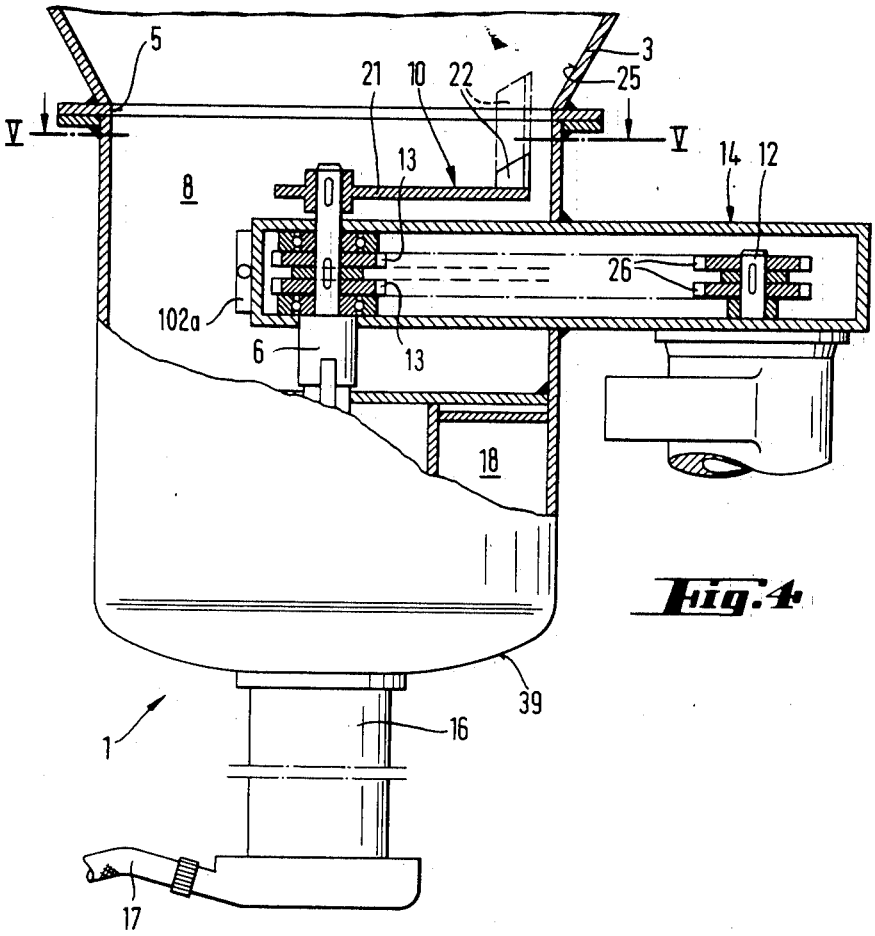
FIG. 4 is a view similar to that of FIG. 2 but showing a second apparatus wherein the upper end portion of the vertical shaft extends above the transmissions and carries a preliminary mixing tool.
Figure 5:
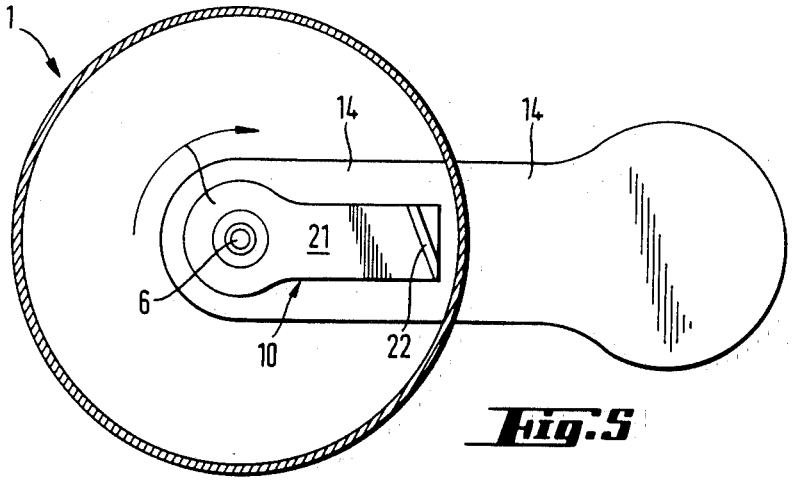
FIG. 5 is a plan view of the structure which is shown in FIG. 4.

FIG. 4 shows a modified mixing unit 1 wherein the mixing shaft 6 is vertical, the same as in the embodiment of FIGS. 1 to 3, but has a portion which extends upwardly beyond the transmission means which transmits torque from the output element 12 of the prime mover 2 and supports a rotary carrier 21 (e.g., a disc, a plate or a flat arm) for one or more orbiting first agitating or mixing tools 22. The carrier 21 and the tool 22 of FIG. 4 together constitute a composite preliminary mixing tool 10 which receives torque from the upper portion of the shaft 6 and whose blade- or paddle-like tool 22 orbits in the first mixing chamber 8 about the axis of the shaft 6 and in close or immediate proximity of the internal surface of the funnel 25, i.e., the tool 22 extends into the outlet 5 to further promote predictable flow of solid material from the silo 3 into the first mixing chamber 8. The tool 22 and its carrier 21 are disposed at a level above that portion of the transmission case 14 which extends into the housing H of the mixing unit 1 shown in FIG. 4. The tool 22 can be used in lieu of or in addition to the mixing tool 9 of FIG. 2; the latter is then installed at a level below the case 14, the same as in FIG. 2. The carrier 21 can support two or more suitably distributed tools 22. The tool 22 of FIG. 4 is a plate-like or blade-like part which can be relatively short (as indicated by solid lines) or much longer (as indicated by broken lines), depending upon whether the tool is to be disposed at a level below the outlet 5 or whether it should extend into or even upwardly beyond such outlet. That surface of the tool 22 in FIG. 4 which faces the observer extends at least substantially radially of the vertical shaft 6 so as to furnish a highly satisfactory agitating, distributing and conveying action. It is also possible to employ one or more ring-shaped or otherwise configurated tools in lieu of or in addition to the illustrated single tool 22. The inclination of the tool 22 with reference to the longitudinal direction of the case 14 can be seen in FIG. 5; the longitudinal direction of the case 14 and the plane of the tool 22 make an oblique angle which need not appreciably deviate from 90 degrees.

Figure 6:
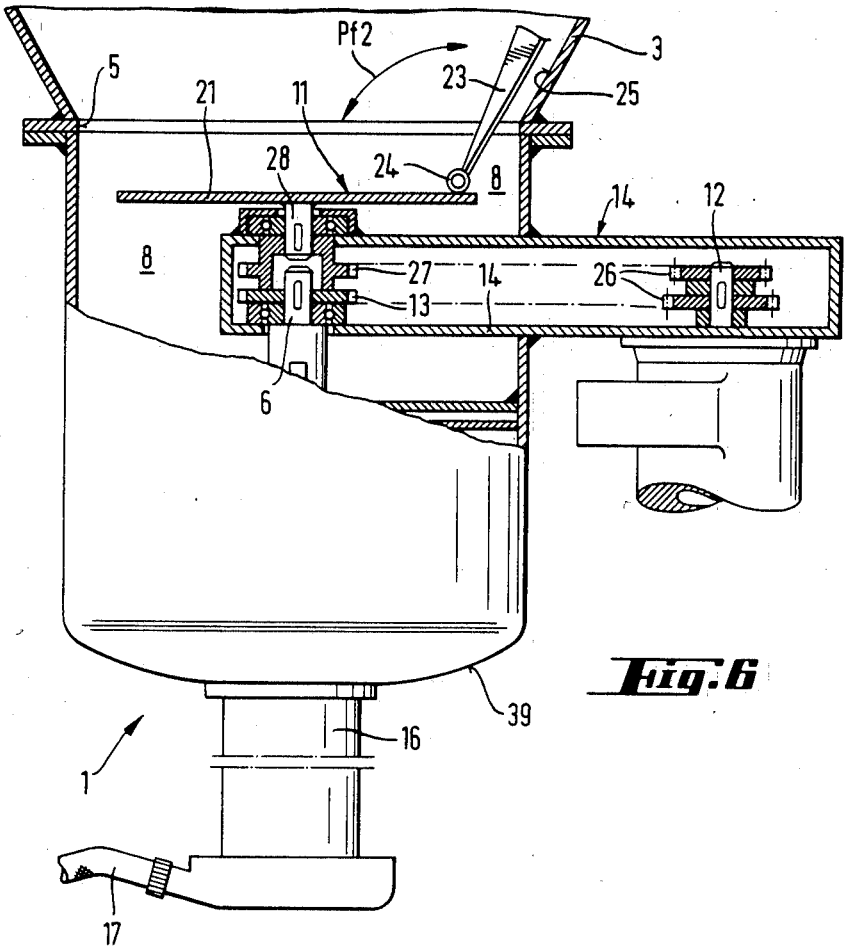
FIG. 6 is a view similar to that of FIG. 2 but showing an apparatus which constitutes a modification of the apparatus shown in FIG. 4.
Figure 7:
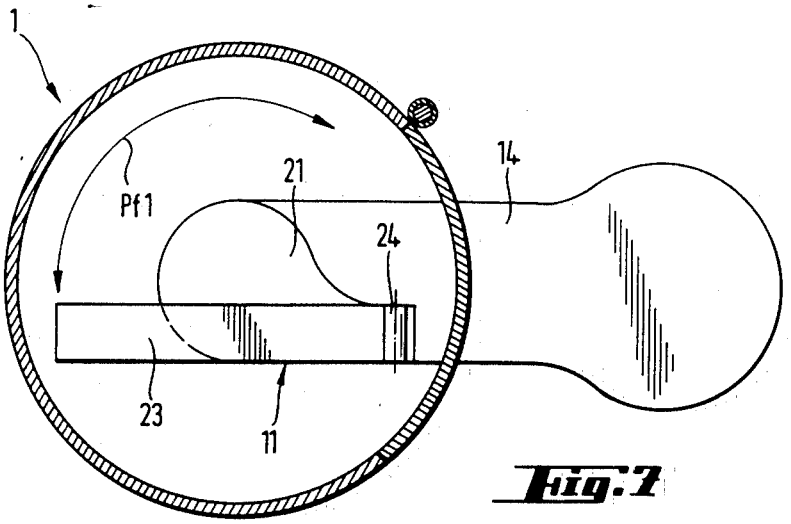
FIG. 7 is a plan view of the structure which is shown in FIG. 6.

The plate- or disc-shaped carrier 21 of FIGS. 6 and 7 supports a first mixing tool 23 which is a finger, arm or blade and is affixed to the carrier 21 by a hinge 24. This tool 23 extends upwardly through the outlet 5 and into the interior of the funnel 25 to ensure predictable descent of flowable solid material into the first mixing chamber 8 of the mixing unit 1. The inclination of the tool 23 in the illustrated operative or extended position can match the inclination of the conical wall of the funnel 25. The carrier 21 and the tool 23 of FIGS. 6 and 7 together constitute a composite preliminary mixing device 11. The position of the tool 23 is preferably selected in such a way that it does not interfere with convenient attachability or detachability of the housing H of the mixing unit 1 from the funnel 25 of the silo 3. The illustrated tool 23 is a stirring blade which is moved to the operative or erected position of FIG. 6 in response to rotation of the vertical shaft 6 in a first direction and which is automatically pivoted to the inoperative or collapsed position of FIG. 7 in response to rotation of the shaft 6 in the opposite direction. This can be readily achieved by the simple expedient of properly selecting the configuration and inclination of the two major surfaces of the tool 23. The directions in which the prime mover 2 can rotate the shaft 6 are indicated by a double-headed arrow Pf1 which is shown in FIG. 7. The double-headed arrow Pf2 denotes in FIG. 6 the directions in which the tool 23 is respectively pivoted in response to rotation of the shaft 6 in a clockwise and in a counterclockwise direction. The carrier 21 of FIGS. 6 and 7 can support two or more suitably distributed blade-, finger- or paddle-like tools 23. The illustrated tool 23 acts not unlike a propeller screw or blade and can be moved to the erected or collapsed position by the simple expedient of properly selecting the direction of rotation of the vertical shaft 6. When the tool 23 assumes the erected or operative position of FIG. 6, it preferably makes with the plane of its carrier 21 an obtuse angle so that its inclination matches that of the conical wall of the funnel 25. The tool 23 is then preferably closely adjacent to the internal surface of the funnel 25 so as to reduce the likelihood of agglomeration of solid material at the inner side of the conical wall of the funnel and to even more reliably promote the flow of solid material into the first chamber 8. When the tool 23 is caused to assume the collapsed position of FIG. 7, it is located entirely within the confines of the chamber 8 so that the housing H can be readily detached from or pivoted relative to the funnel-shaped portion 25 of the silo 3, if necessary. In many instances, the carrier 21 of FIGS. 6 and 7 will be equipped with two blade-like tools 23 which are located diametrically or nearly diametrically opposite each other in such positions that they do not interfere with each other's movements to the erected or collapsed positions.

As can be seen in FIGS. 2 and 4, the output element 12 of the prime mover 2 carries two coaxial sprocket wheels 26, and the shaft 6 carries two coaxial sprocket wheels 13 so that the transmission in the respective case 14 can comprise two discrete endless chains or a single endless chain which is trained over two pairs of sprocket wheels (13 and 26). The provision of two discrete chains is preferred in order to avoid excessive stressing of a single endless chain.

The embodiment of FIGS. 6 and 7 deviates from the embodiments of FIGS. 1–3 and 4–5 in that the lower sprocket wheel 26 on the output element 12 of the prime mover 2 cooperates with a single sprocket wheel 13 to transmit torque to the shaft 6 by way of a first endless chain. A second or upper sprocket wheel 26 on the output element 12 cooperates with a sprocket wheel 27 which can rotate relative to the shaft 6 and carries a shaft 28 (e.g., an upwardly extending stub) which transmits torque to the device 11 including the carrier 21 and its tool or tools 23. Thus, the speed of the carrier 21 which is shown in FIG. 6 can deviate from the speed of the shaft 6. The arrangement is preferably such that the ratio of the transmission including the sprocket wheel 13 of FIG. 6 is higher than that of the transmission including the sprocket wheel 27, i.e., the prime mover 2 drives the shaft 6 at an RPM which is higher than the RPM of the shaft 28 for the carrier 21 and tool 23. Such selection of the two transmission ratios is especially desirable and advantageous when the hinge 24 is remote from the shaft 28 and the tool 23 is relatively long so that its tip must travel along an arcuate path having a large radius of curvature in order to move between the solid-line operative or erected position of FIG. 6 and the collapsed or retracted position of FIG. 7. The selection of the two transmission ratios will depend also on the nature of the material which is stored in the silo 3 and on the desired rate at which such material should enter the first chamber 8 in the housing H of the mixing unit 1.

Figure 9:
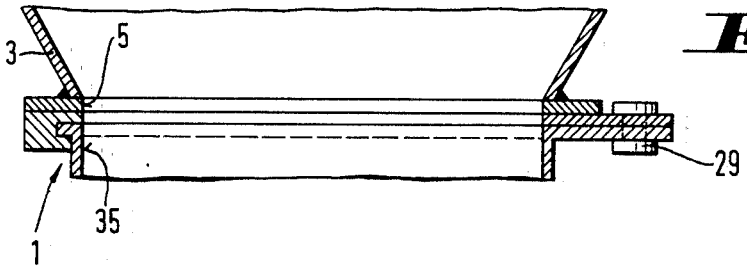
FIG. 9 is a fragmentary vertical sectional view as seen in the direction of arrows from the line IX—IX of FIG. 8.
Figure 8:
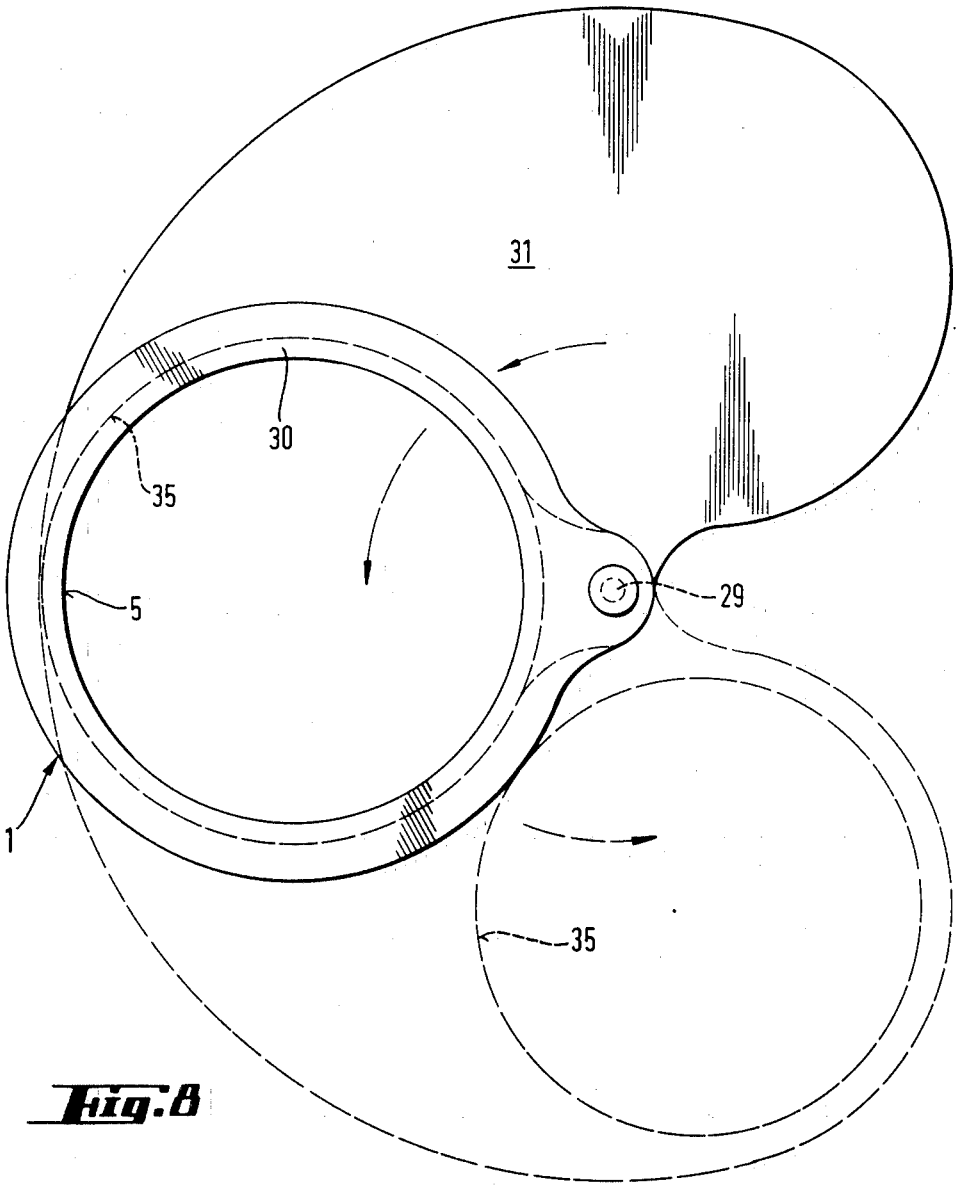
FIG. 8 is a plan view of the apparatus of FIGS. 1 to 3, showing a lid which can be used to seal the outlet of the source of flowable material when the housing of the mixing unit is moved out of register with the outlet.

As mentioned above, and as shown in each of the illustrated embodiments of the improved mixing and metering apparatus, the housing H of the mixing unit 1 is preferably mounted directly on the funnel-shaped portion 25 of the silo 3 without the interposition of one or more adapters or the like. In spite of such direct suspension of the housing H on the silo 3, it is still possible to move the housing out of the way in order to gain access to the outlet 5 and/or to seal the outlet so that it will discontinue the discharge of flowable material. FIGS. 8 and 9 show that the housing H can be connected to the funnel-shaped portion 25 of the silo 3 by the aforementioned vertical pivot 29 whose axis is parallel to the axis of the shaft 6 and which is disposed laterally of the outlet 5. The upper portion of the housing H has a laterally extending plate or lid 31 which moves below and into register with the outlet 5 when the flange 30 is moved out of register with the outlet. This flange carries the lid 31 at a level immediately below the outlet 5. The dimensions of the lid 31 suffice to completely close the outlet 5 when the housing H is moved to the broken-line position of FIG. 8. The lid 31 can form part of a circular plate whose center is located on the axis of the pivot 29. Thus, the center of curvature of the external surface **31*a* of the lid 31 is located on the axis of the pivot 29**.

The edge 35 of the flange 30 on the housing H can be rounded or it can be sharp in order to facilitate the pivoting of the housing H about the vertical axis of the pivot 29. If the edge 35 is rounded, the flange 30 can readily deflect the adjacent solid flowable material during movement of the housing H into or from register with the outlet 5. If the edge 35 is sharp, it actually cuts through the adjacent flowable material and again facilitates the movement of the housing H to and from a position of register with the outlet 5.

Figure 11:
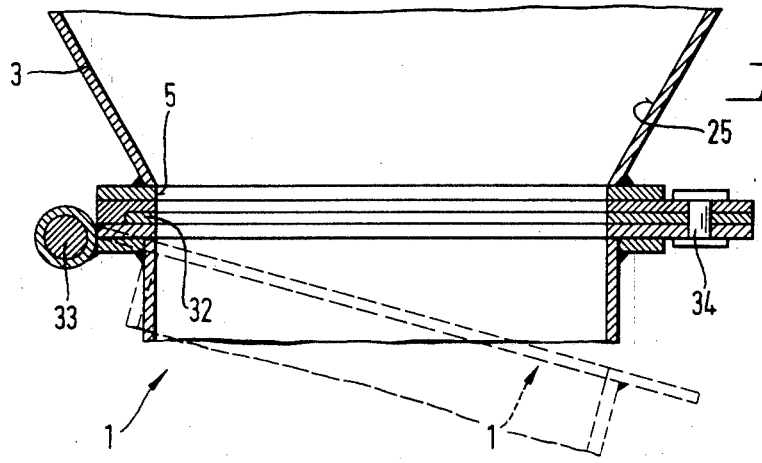
FIG. 11 is a fragmentary sectional view as seen in the direction of arrows from the line XI—XI of FIG. 10.
Figure 10:
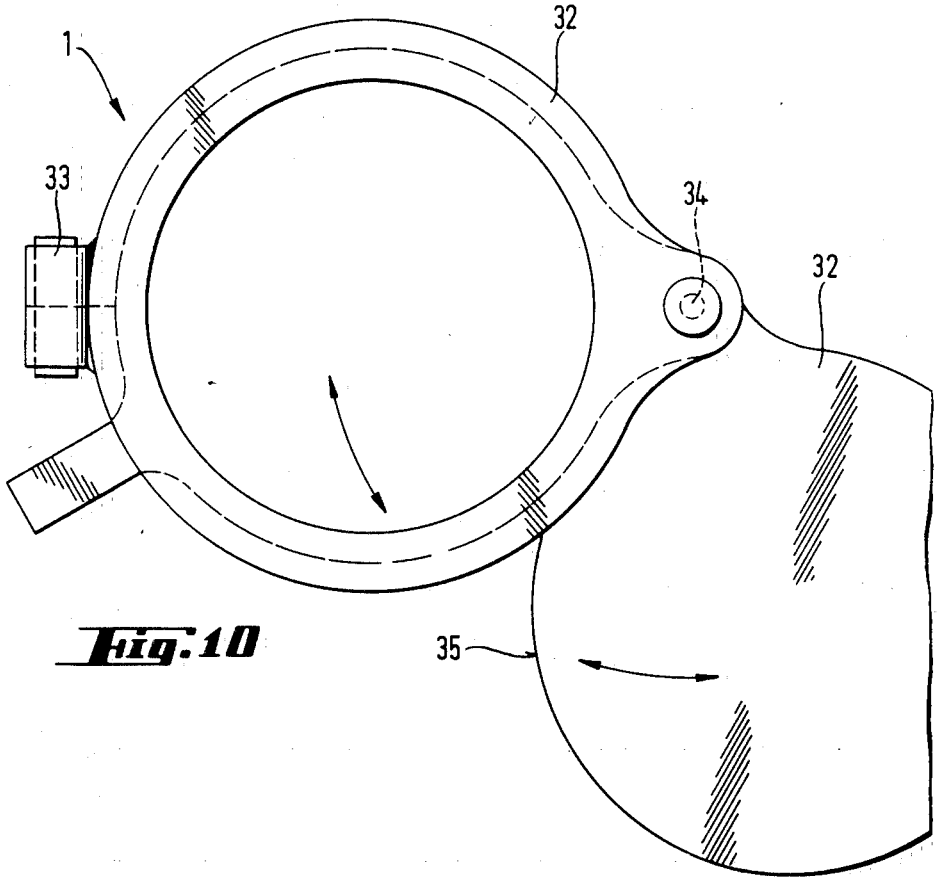
FIG. 10 is a fragmentary plan view of a modified apparatus wherein the housing of the mixing unit is pivotable about a horizontal axis and the apparatus comprises a discrete closure which is movable relative to the housing.

FIGS. 10 and 11 illustrate a somewhat different mode of securing the housing H of the mixing unit 1 to the funnel-shaped portion 25 of the silo 3. The apparatus comprises a discrete closure 32 which is a plate pivotable about the vertical axis of a rivet 34 or another suitable pivot member that is laterally adjacent to the outlet 25 and enables the closure 32 to pivot between the solid-line and broken-line positions shown in FIG. 10. The flange 30 of the housing H is pivotable about a horizontal axis which is defined by a hinge 33 so that it can be pivoted between the solid-line and broken-line positions of FIG. 11. The housing H will be pivoted to the broken-line position of FIG. 11 after the closure 32 is moved to the broken-line position of FIG. 10 to seal the outlet 5 from below. Pivoting of the housing H to the broken-line position of FIG. 11 allows for convenient repair work upon and/or cleaning of the mixing unit 1.

The closure 32 can be provided with rounded or sharp edges 35A for the purposes described in connection with FIGS. 9 and 10, i.e., to facilitate its movements between the solid-line and broken-line positions of FIG. 10.

FIG. 2 further shows a horizontal partition 36 which is installed in the housing H between the chambers 8 and 18. This partition is disposed at a level above a turntable 37 which is located below the level of admission of liquid and carries the second mixing tools 7 in such a way that one or more tools 7 are disposed above and one or more tools 7 are disposed below the partition. The lowermost portion of the housing H has a discharge opening 38 for treated material which admits such material into the evacuating pump 16 and whose diameter is a small fraction of the maximum diameter of the second mixing chamber 18. The housing portion which defines the opening 38 acts not unlike a flow restrictor which ensures that the material dwells in the chamber 18 for an interval of time that is necessary or desirable for adequate treatment before the material enters the evacuating pump 16 and is conveyed to the locale or locales of use by way of one or more conduits 17. The provision of a flow restricting region below the second mixing chamber 18 is desirable and advantageous in connection with the treatment of a number of materials, especially if the housing H has one or more air admitting openings 15 which are intended to admit air in quantities that are needed to confine in the treated material a requisite number of bubbles which promote the transport of treated material through the pump 16 and conduit or conduits 17. The bottom wall 39 of the housing H is preferably rounded so that it has a concave upper side which promotes uniform flow of treated material toward and into the opening 38. The configuration of the lower tool or tools 7 preferably conforms to the shape of the adjacent inner side of the bottom wall 39.

In the event of a malfunction, e.g., in the event of clogging of the pump 16, outlet opening 38 and/or conduit or conduits 17, the liquid would rise into the first mixing chamber 18 and would mix with the descending flowable solid material so that the first mixing tool or tools 9 would encounter a much greater resistance to rotation. The energy consumption of the prime mover 2 would increase accordingly, and this can be ascertained by a suitable detector 102 serving to generate a suitable signal or to automatically interrupt the supply of energy to the prime mover 2, i.e., the apparatus then comes to a standstill. Alternatively, the prime mover 2 comes to a standstill by the simple expedient that the rate at which it can receive energy is limited so that a stoppage of the unit 1 takes place as soon as the tool or tools 9 in the chamber 8 encounter a maximum permissible resistance to rotation with the shaft 6. Still further, the aforementioned detector 102 can interrupt the admission of liquid into the housing H by closing a valve 307 (FIG. 1) so that the liquid cannot rise into the interior of the silo 3. As a rule, the detector 102 will be designed to stop the prime mover 2 in response to entry of liquid into the first chamber 8 as a result of greatly increased resistance which the first tool or tools 9 then offer to rotation in the first mixing chamber 8. This is shown in FIG. 4 wherein a moisture sensor **102*a* is installed in the chamber 8 to generate a signal in response to detection of moisture. Such signal is used by the detector 102 to arrest the motor 2**.

An important advantage of the improved apparatus is that the shaft 6 is vertical and is disposed preferably centrally of and below the outlet 5 of the silo 3. This greatly reduces the wear upon the tools and other moving parts of the apparatus due to the absence of one-sided stressing of such moving parts. The wear upon the bearings is reduced to a fraction of the wear in conventional apparatus. Moreover, uniform wear renders it possible to use the parts longer than in the event of non-uniform (one-sided) wear.

Another important advantage of the improved apparatus is that it is not necessary to install a flow restrictor between the outlet 5 and the housing H of the mixing unit 1. This contributes to higher output of the apparatus. If a retardation of flow of the material through the apparatus is necessary, e.g., to ensure the entrapment of a requisite number of bubbles in the treated material, such flow restricting action can be carried out in the region where it is most beneficial, particularly in the region of the tool or tools 7 in the second chamber 18.

The improved apparatus takes full advantage of the force of gravity in that the material which is confined in the lower portion 25 of the silo 3 can descend by gravity alone or, if an even more predictable discharge of material is desired, the first tool or tools can perform such function with minimal expenditures in energy and ancillary to their primary function or functions of preventing classification of the ingredients of descending material and of ensuring uniform distribution of the descending material on its way into the range of the tool or tools in the second chamber 18. The danger of classification (i.e., of segregation of various ingredients of the flowable material) is much less pronounced than in conventional apparatus because the material can descend vertically downwardly and directly into the range of one or more first mixing or stirring tools. The first mixing tool or tools further contribute to uniform density of the descending material so that the material can be metered with a higher degree of accuracy than in conventional apparatus. This is important when the finished product is to be admitted into further processing units at a construction site or the like where the further processing units must receive accurately metered quantities of plaster, mortar or the like.

The placing of the prime mover 2 laterally adjacent the mixing unit 1 has been found to be desirable, practical and advantageous because the prime mover is within reach for inspection, adjustment and/or repair. However, it is also within the purview of the invention to install the prime mover 2 coaxially with the shaft 6. For example, the prime mover 2 could be mounted on top of the silo 3 and its output element 12 would then extend vertically downwardly through the silo and would transmit torque to the upper end portion of the shaft 6. This could create problems, especially if the silo 3 is relatively large so that the prime mover would have to be provided with a long, heavy and expensive output element. The illustrated prime mover is more readily accessible than a prime mover at the top of a tall silo or an analogous source of flowable solid material. Mounting of the prime mover 2 in such a way that its output element 12 is parallel to the shaft 6 is preferred at this time. However, and as explained above, it is also possible to mount the prime mover 2 in such a way that its output element 12 extends transversely of the shaft 6, e.g., to use a prime mover with a horizontal output element and one or more bevel gear, spur gear or Cardan shaft transmissions between the transversely extending output element and the shaft 6. The placing of the transmission or transmissions into an at least substantially enclosed case reduces the likelihood of rapid contamination, especially when the silo 3 contains or includes pulverulent material or when the nature of the flowable solid material is such that it could attack the elements of the transmission or transmissions in the case 14. The feature that a portion of the case 14 extends directly into the housing H of the mixing unit 1 contributes to compactness of the apparatus and renders it possible to use such portion of the case 14 (namely the roof-shaped part 19 or an equivalent part) as a means for contributing to more uniform distribution of descending flowable solid material in the chambers 8 and 18. The diameter of the housing H is or can be large since such housing can be placed directly below the outlet 5 and can constitute a downwardly extending extension of the funnel-shaped portion 25 of the silo 3.

The provision of means for admitting liquid into the housing H, and especially into the second chamber 18, is highly desirable and advantageous in connection with the treatment of a wide variety of flowable solid materials, especially building materials. It is clear that the apparatus can be provided with means for admitting two or more different types of liquid plasticizing, bonding or other media from two or more different sources. For example, the apparatus can admit two or more differently colored liquids to color the material which is to be evacuated by the pump 16. The apparatus can be used to convert or process white lime into lime milk as an intermediate stage of a process. Many other types of flowable solid materials can be processed with equal or similar advantage.

While it is possible to use the pump 16 as a means for admitting the finished product into storage, such pump is preferentially employed as a means for conveying the finished product directly to one or more locales of use or to one or more further processing machines or apparatus. The pump 16 is preferably coaxial with the shaft 6 and can but need not receive motion from the motor 2. Such pump can be used with particular advantage for the transport of plaster and/or mortar to several levels or stories in a building which is under construction or undergoes repair. It has been found that the pump 16 is capable of transporting the finished product through distances which considerably exceed the distances that can be covered by a dry pulverulent or granular material with a pneumatic conveyor system for delivery into a mixing or analogous machine which is installed directly at the locus of actual use.

The likelihood of decomposition or breakdown of flowable solid material which issues from the silo 3 into two or more ingredients is practically zero because the material can descend by gravity which is not conducive to segregation or classification according to weight, particle size or the like; because the material is thereupon divided into two preferably equal streams by the roof-shaped part 19 of the case 14; and because the material is also treated by the tool or tools in the first mixing chamber 8. Thus, even if the material exhibits a strong tendency to be classified into its ingredients, such tendency is effectively opposed in several different ways so that the second mixing chamber 18 receives a homogeneous material which can be properly processed by mixing, admission of one or more liquid media and/or admission of one or more streams of air or another gaseous fluid.

The placing of one or more first mixing tools at a level above the case 14 (as shown in FIGS. 4 to 7) is particularly desirable and advantageous when the flow of material from the outlet 5 into the second chamber 18 must be assisted all the way from the outlet. The extent to which the first tool or tools are caused to penetrate into the outlet 5 or even deeper into the funnel-shaped portion 25 of the silo 3 will depend on the ability or lack of ability of the material to flow by gravity into the first chamber 8. As mentioned above, the first mixing tool or tools can be designed to automatically rise to their erected positions when the shaft 6 or 28 is rotated in a first direction and to automatically assume their collapsed or retracted positions in response to rotation of the shaft 6 or 28 in the opposite direction. Such automatic pivoting of the first mixing tool or tools 23 is desirable and advantageous because these tools can be moved out of the way when the housing H is to be detached from the silo 3 or is to be moved to a position out of register with the outlet 5 in a manner as shown in FIGS. 8–9 or 10–11. Moreover, the pivotable first tool or tools can be caused to extend well into the funnel-shaped portion 25 and into close proximity of the internal surface of the latter as long as the mixing unit 1 is in actual use and to return into the housing H when the operation of the unit 1 is interrupted. Pivoting of the first tool or tools into immediate proximity of the inner side of the funnel-shaped portion 25 is particularly desirable and advantageous when the flowable solid material does not exhibit a pronounced tendency to flow along the inner side of the portion 25 and/or when the flowable material tends to agglomerate along the inner side of the portion 25 for other reasons.

The important advantages of the feature that the housing H of the mixing unit 1 can be mounted directly on the silo 3 have been pointed out above. An additional advantage of such mounting is that one can dispense with the aforediscussed adapter or adapters and that the means for closing the outlet 5, when the latter is out of register with the housing H, can form a component part of the housing. The feature which is shown in FIGS. 8 and 9 is desirable on the ground that the housing H can be moved into and from register with the outlet 5 with a minimum of effort and also because the outlet 5 is automatically sealed as soon as the housing H and its flange 30 are moved to the broken-line positions of FIG. 8.

The provision of the detector 102 or analogous means for preventing the admitted liquid or liquids from rising beyond a preselected maximum level constitutes a desirable safety feature of the improved apparatus. While it is also possible to install one or more probes or analogous monitoring devices in the housing H so that such device or devices generate signals when the level of admitted liquid rises beyond the preselected value, the illustrated detector 102 is preferred at this time because it or its parts need not be installed in the interior of the housing H and need not come into actual contact with the liquid and/or other materials which are being treated in the mixing unit 1. In many instances, the liquid will rise beyond the preselected level if the pump 16 is incapable of evacuating the finished product at the desired or anticipated rate.

Another important advantage of the improved apparatus is that it requires a single prime mover if the pump 16 is driven by the motor 2. This reduces the energy requirements and contributes to compactness of the improved apparatus. Furthermore, the apparatus is less prone to malfunction and the repair work is less expensive and can be completed within short intervals of time. Still further, the provision of a single prime mover contributes to simplicity of operation and safety of the apparatus. It has been found that the improved apparatus can process large quantities of material per unit of time and that the quality of the finished product is not only highly satisfactory but more satisfactory than the quality of products which are turned out by conventional apparatus. As mentioned above, the improved apparatus not only reduces the likelihood of segregation of the ingredients of pulverulent or granular material which is stored in the silo 3 but actually counteracts such tendency of the flowable material. This is important and desirable when the apparatus is used for the making of plaster. Such product can be transported by the pump 16 through considerable distances of up to and even in excess of 60 meters. This is due to the fact that the consistency of the finished product is predictable and that the product can contain uniformly distributed gas bubbles. It has been found that the wear upon the shell of the pump 16 is not pronounced even when the pump is required to transport the finished product through the aforediscussed distances for extended periods of time.

Still another important advantage of the improved apparatus is its compactness. Thus, the space requirements of the mixing unit 1 and of the prime mover 2 are surprisingly small so that such parts can be suspended on existing silos or analogous sources of flowable material without necessitating any reinforcement of the silos and/or the building of a separate foundation for the mixing unit. The space below the outlets of many conventional silos is amply sufficient for the installation of the mixing unit of the improved apparatus. The silo can be set up at any desired location close to or at a building site or the like and, depending on its dimensions and capacity, can be installed directly on the ground or on a relatively simple and inexpensive foundation.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A mixing and metering apparatus for flowable solid materials, such as building materials, fertilizers, mixtures of two or more flowable solid ingredients and the like, comprising a source of supply of flowable material, said source having a lower portion and an outlet in said lower portion; and a mixing unit for the material which issues by way of said outlet, said unit having a first mixing chamber receiving flowable material from said outlet, first mixing means including at least one mobile first mixing tool in said chamber, a second mixing chamber arranged to receive material from said first chamber, a vertical drive shaft at a level below said outlet, second mixing means including at least one second mixing tool disposed in said second chamber and receiving motion from said shaft, a prime mover for said shaft, said prime mover including a motor disposed laterally of said shaft, and transmission means connecting said motor with said shaft; and an at least substantially closed case for said transmission means, said case including a portion extending into said unit.

2. A mixing and metering apparatus for flowable solid materials, such as building materials, fertilizers, mixtures of two or more flowable solid ingredients and the like, comprising a source of supply of flowable material, said source having a lower portion and an outlet in said lower portion; a mixing unit for the material which issues by way of said outlet, said unit having a first mixing chamber receiving flowable material from said outlet, first mixing means including at least one mobile first mixing tool in said chamber, a second mixing chamber arranged to receive material from said first chamber, a vertical drive shaft at a level below said outlet, and second mixing means including at least one second mixing tool disposed in said second chamber and receiving motion from said shaft; and means for evacuating flowable material from said second chamber, including a pump which is coaxial with said shaft.

3. The apparatus of claim 2 wherein said pump is a spindle drag pump.

4. A mixing and metering apparatus for flowable solid materials, such as building materials, fertilizers, mixtures of two or more flowable solid ingredients and the like, comprising a source of supply of flowable material, said source having a lower portion and an outlet in said lower portion; a mixing unit for the material which issues by way of said outlet, said unit having a first mixing chamber receiving flowable material from said outlet, first mixing means including at least one mobile first mixing tool in said chamber, a second mixing chamber arranged to receive material from said first chamber, a vertical drive shaft at a level below said outlet, second mixing means including at least one second mixing tool disposed in said second chamber and receiving motion from said shaft, a prime mover, and transmission means for transmitting torque from said prime mover to said shaft; a case at least substantially confining said transmission means and having a portion extending into said unit, said first mixing tool being disposed at a level below said case; and means for directing the material from said outlet into said first mixing chamber, said directing means being disposed at a level below said first mixing tool.

5. The apparatus of claim 4, wherein said portion of said base has a predetermined width and said directing means forms part of said case and has a roof-shaped member having a ridge facing said outlet and having a width which at least approximates the width of said portion.

6. A mixing and metering apparatus for flowable solid materials, such as building materials, fertilizers, mixtures of two or more flowable solid ingredients and the like, comprising a source of supply of flowable material, said source having a lower portion and an outlet in said lower portion; a mixing unit for the material which issues by way of said outlet, said unit having first mixing chamber receiving flowable material from said outlet, first mixing means including at least one mobile first mixing tool in said chamber, a second mixing chamber arranged to receive material from said first chamber, a vertical drive shaft at a level below said outlet, second mixing means including at least one second mixing tool disposed in said second chamber and receiving motion from said shaft, a prime mover, and transmission means connecting said prime mover with said shaft; and a case at least partially confining said transmission means and having a portion extending into said unit, said shaft having a portion extending upwardly beyond said portion of said case and said first mixing tool being mounted on said portion of said shaft.

7. A mixing and metering apparatus for flowable solid materials, such as building materials, fertilizers, mixtures of two or more flowable solid ingredients and the like, comprising a source of supply of flowable material, said source having a lower portion and an outlet in said lower portion; a mixing unit for the material which issues by way of said outlet, said unit having a first mixing chamber receiving flowable material from said outlet, first mixing means including at least one mobile first mixing tool in said chamber, said first mixing tool including a rotary member, a second mixing chamber arranged to receive material from said first chamber, a vertical drive shaft at a level below said outlet, and second mixing means including at least one second mixing tool disposed in said second chamber and receiving motion from said shaft; and drive means for said shaft, including a motor and a first transmission connecting said motor with said shaft, said rotary member being provided above said shaft and including a carrier, said drive means further including a second transmission arranged to rotate said carrier and said rotary member further comprising at least one material stirring tool provided on said carrier.

8. The apparatus of claim 7, wherein said stirring tool is inclined upwardly and outwardly with reference to said shaft in a direction toward said outlet.

9. The apparatus of claim 7, wherein said stirring tool includes a paddle-like component and means for movably securing said component to said carrier.

10. The apparatus of claim 9, wherein said component has a material-contacting surface which extends at least substantially radially of said shaft and includes a portion extending into said outlet.

11. The apparatus of claim 9, wherein said component is arranged to pivot to an operative position in response to rotation of said carrier in a first direction and to pivot to an inoperative position in response to rotation of said carrier in a second direction counter to said first direction.

12. The apparatus of claim 11, wherein said source includes a substantially conical wall surrounding said outlet and said component is at least substantially parallel to said wall in the operative position of such component.

13. A mixing and metering apparatus for flowable solid materials, such as building materials, fertilizers, mixtures of two or more flowable solid ingredients and the like, comprising a source of supply of flowable material, said source having a lower portion and an outlet in said lower portion; and a mixing unit for the material which issues by way of said outlet, said unit having a first mixing chamber receiving flowable material from said outlet, first mixing means including a plurality of first mixing tools in said chamber, a second mixing chamber arranged to receive material from said first chamber, a vertical drive shaft at a level below said outlet, said first mixing tools including two pivotable agitating components disposed substantially diametrically opposite one another with reference to said shaft, and second mixing means including at least one second mixing tool disposed in said second chamber and receiving motion from said shaft.

14. A mixing and metering apparatus for flowable solid materials, such as building materials, fertilizers, mixtures of two or more flowable solid ingredients and the like, comprising a source of supply of flowable material, said source having a lower portion and an outlet in said lower portion; a mixing unit for the material which issues by way of said outlet, said unit having a first mixing chamber receiving flowable material from said outlet, first mixing means including at least one mobile first mixing tool in said chamber, a second mixing chamber arranged to receive material from said first chamber, a vertical drive shaft at a level below said outlet, and second mixing means including at least one second mixing tool disposed in said second chamber and receiving motion from said shaft; and drive means for said shaft and said first mixing tool, including a prime mover having a rotary output element, a first transmission connecting said output element with said shaft and a second transmission connecting said output element with said first mixing tool.

15. The apparatus of claim 14, wherein at least one of said transmissions includes an endless chain.

16. The apparatus of claim 14, wherein said transmissions have different ratios.

17. The apparatus of claim 16, wherein said ratios are such that the RPM of said shaft exceeds the RPM of said first mixing tool.

18. A mixing and metering apparatus for flowable solid materials, such as building materials, fertilizers, mixtures of two or more flowable solid ingredients and the like, comprising a source of supply of flowable material, said source having a lower portion and an outlet in said lower portion; a mixing unit for the material which issues by way of said outlet, said unit having a first mixing chamber receiving flowable material from said outlet, first mixing means including at least one mobile first mixing tool in said chamber, a second mixing chamber arranged to receive material from said first chamber, a vertical drive shaft at a level below said outlet, and second mixing means including at least one second mixing tool disposed in said second chamber and receiving motion from said shaft; and means for movably supporting said unit so that the latter is movable between a first position of register and a second position out of register with said outlet.

19. The apparatus of claim 18, wherein said source includes a silo and legs supporting said silo at a level above the ground so that said outlet is located above said unit.

20. The apparatus of claim 18, wherein said shaft is disposed centrally of said outlet.

21. The apparatus of claim 18, further comprising a prime mover for said shaft, said prime mover including a motor disposed laterally of said shaft and further comprising transmission means connecting said motor with said shaft.

22. The apparatus of claim 21, wherein said motor includes a rotary output element which is at least substantially parallel to said shaft.

23. The apparatus of claim 21, wherein said motor includes a rotary output element extending transversely of said shaft.

24. The apparatus of claim 18, further comprising a source of liquid and conduit means for admitting liquid from the respective source into said unit at least substantially coaxially with said shaft and into said second chamber.

25. The apparatus of claim 18, wherein said first mixing tool is provided on and receives torque from said shaft, and further comprising means for admitting a liquid into said second chamber.

26. The apparatus of claim 18, wherein said first mixing tool includes a rotary member.

27. The apparatus of claim 18, wherein said mixing unit comprises a plurality of first mixing tools.

28. The apparatus of claim 18, further comprising means for securing said unit directly to said source.

29. The apparatus of claim 18, wherein said supporting means defines for said unit a substantially vertical pivot axis which is laterally adjacent to said outlet.

30. The apparatus of claim 18, further comprising means for sealing said outlet in response to movement of said unit to said second position.

31. The apparatus of claim 30, wherein said sealing means comprises a lid which shares the movements of said unit relative to said source.

32. A mixing and metering apparatus for flowable solid materials, such as building materials, fertilizers, mixtures of two or more flowable solid ingredients and the like, comprising a source of supply of flowable material, said source having a lower portion and an outlet in said lower portion; a mixing unit for the material which issues by way of said outlet, said unit having a first mixing chamber receiving flowable material from said outlet, first mixing means including at least one mobile first mixing tool in said chamber, a second mixing chamber arranged to receive material from said first chamber, a vertical drive shaft at a level below said otulet, and second mixing means including at least one second mixing tool disposed in said second chamber and receiving motion from said shaft; means defining for said mixing unit a substantially vertical pivot axis about which said unit is movable to place its first mixing chamber into and from a position of register with said outlet; and a closure movable into and from sealing engagement with said outlet relative to said unit.

33. The apparatus of claim 32, wherein said closure is pivotable about a substantially vertical axis.

34. A mixing and metering apparatus for flowable solid materials, such as building materials, fertilizers, mixtures of two or more flowable solid ingredients and the like, comprising a source of supply of flowable material, said source having a lower portion and an outlet in said lower portion; a mixing unit for the material which issues by way of said outlet, said unit having a first mixing chamber receiving flowable material from said outlet, first mixing means including at least one mobile first mixing tool in said chamber, a second mixing chamber arranged to receive material from said first chamber, a vertical drive shaft at a level below said outlet, and second mixing means including a plurality of second mixing tools disposed in said second chamber and receiving motion from said shaft; and means for admitting a liquid into said second chamber, said mixing unit further comprising a turntable mounted on said shaft in said second chamber at a level below said liquid admitting means, at least one of said second mixing tools being provided on and at a level above said turntable and at least one second mixing tool being also provided on and disposed at a level below said turntable.

35. A mixing and metering apparatus for flowable solid materials, such as building materials, fertilizers, mixtures of two or more flowable solid ingredients and the like, comprising a source of supply of flowable material, said source having a lower portion and an outlet in said lower portion; and a mixing unit for the material which issues by way of said outlet, said unit having a first mixing chamber receiving flowable material from said outlet, first mixing means including at least one mobile first mixing tool in said chamber, a second mixing chamber arranged to receive material from said first chamber, a vertical drive shaft at a level below said outlet, second mixing means including at least one second mixing tool disposed in said second chamber and receiving motion from said shaft, and a housing for said chambers, said shaft and said mixing means, said housing having a bottom wall below said second chamber and a substantially centrally located material discharging opening in said bottom wall.

36. The apparatus of claim 35, wherein said bottom wall has an inner side which slopes toward said opening, said tool of said second mixing means being adjacent to said inner side and having an outline which at least substantially conforms to the shape of said inner side.

37. A mixing and metering apparatus for flowable solid materials, such as building materials, fertilizers, mixtures of two or more flowable solid ingredients and the like, comprising a source of supply of flowable material, said source having a lower portion and an outlet in said lower portion; a mixing unit for the material which issues by way of said outlet, said unit having a first mixing chamber receiving flowable material from said outlet, first mixing means including at least one mobile first mixing tool in said chamber, a second mixing chamber arranged to receive material from said first chamber, a vertical drive shaft at a lever below said outlet, second mixing means including at least one second mixing tool disposed in said second chamber and receiving motion from said shaft, and a housing having a flange which is disposed directly below said outlet; and means for movably securing said housing to said source so that said flange is movable into and out of a position of register with said outlet, said flange having a rounded edge portion disposed below and immediately adjacent to said outlet.

38. A mixing and metering apparatus for flowable solid materials, such as building materials, fertilizers, mixtures of two or more flowable solid ingredients and the like, comprising a source of supply of flowable material, said source having a lower portion and an outlet in said lower portion; a mixing unit for the material which issues by way of said outlet, said unit having a first mixing chamber receiving flowable material from said outlet, first mixing means including at least one mobile first mixing tool in said chamber, a second mixing chamber arranged to receive material from said first chamber, a vertical drive shaft at a level below said outlet, second mixing means including at least one second mixing tool disposed in said second chamber and receiving motion from said shaft, and a housing having a flange which is disposed directly below said outlet; and means for movably securing said housing to said source so that said flange is movable into and out of a position of register with said outlet, said flange having a sharp circumferential edge arranged to cut across the flowable material in said outlet while said housing is moved from said position.

39. A mixing and metering apparatus for flowable solid materials, such as building materials, fertilizers, mixtures of two or more flowable solid ingredients and the like, comprising a source of supply of flowable material, said source having a lower portion and an outlet in said lower portion; a mixing unit for the material which issues by way of said outlet, said unit having a first mixing chamber receiving flowable material from said outlet, first mixing means including at least one mobile first mixing tool in said chamber, a second mixing chamber arranged to receive material from said first chamber, a vertical drive shaft at a level below said outlet, and second mixing means including at least one second mixing tool disposed in said second chamber and receiving motion from said shaft; means for admitting a liquid into said second chamber; and detector means for generating signals when the admitted liquid rises beyond a preselected level.

40. The apparatus of claim 39, further comprising prime mover means for said shaft, said detector means including means for arresting said prime mover means when the liquid rises beyond said preselected level.

41. The apparatus of claim 39, wherein said detector means includes means for interrupting the admission of liquid into said unit.

* * * * *